United States Patent [19]

Kimbrough

[11] Patent Number: 4,567,626

[45] Date of Patent: Feb. 4, 1986

[54] IMPLOSION PROTECTION BAND FOR CRT

[75] Inventor: Laurence B. Kimbrough, Lititz, Pa.

[73] Assignee: RCA Corporation, Princeton, N.J.

[21] Appl. No.: 200,141

[22] Filed: Oct. 24, 1980

[51] Int. Cl.[4] ..... B65D 63/02

[52] U.S. Cl. ..... 24/20 CW; 24/23 W; 220/2.1 A

[58] Field of Search ..... 24/16 PB, 20 R, 20 CW, 24/20 CE, 20 W, 23 R, 23 W; 220/2.1 A

[56] References Cited

U.S. PATENT DOCUMENTS

| | | | |
|---|---|---|---|
| 988,090 | 3/1911 | Hamilton | 24/20 TT |
| 3,332,570 | 7/1967 | Powell et al. | 24/23 W |
| 3,978,899 | 9/1976 | Schroder | 24/20 CW |
| 4,154,158 | 5/1979 | Leslie et al. | 100/2 |
| 4,160,510 | 7/1979 | Wardell, Jr. | 24/23 R |
| 4,237,584 | 12/1980 | Oetiker | 24/20 CW |

*Primary Examiner*—Paul J. Hirsch

*Attorney, Agent, or Firm*—E. M. Whitacre; D. H. Irlbeck; L. L. Hallacher

[57] ABSTRACT

A tensioning band includes a plurality of notches in the free end. Formed in the notches are tabs which extend between the free end and the tensioned loop to prevent the loop from moving against the article being tensioned and thereby relaxing the tension.

4 Claims, 3 Drawing Figures

IMPLOSION PROTECTION BAND FOR CRT

BACKGROUND OF THE INVENTION

This invention relates generally to banding articles and particularly to a novel band for applying implosion protection to a cathode ray tube (CRT).

There are varied instances in the art where there is a need for a tensioned band about an article. In many instances the band must be accurately tensioned with a predetermined tension. An example of a case where a band must be applied to an article with a known tension is that of implosion protecting a CRT. A CRT includes a large evacuated glass envelope. Because the envelope is evacuated, atmospheric pressure tends to collapse, or implode, the tube resulting in a potentially hazardous condition. It has been learned that the hazard of implosion can be greatly reduced by applying a tensioned band around the envelope in the stress area which exists on the sidewall between the faceplate and the frit seal where the faceplate panel and the envelope funnel are joined.

In one method of applying a band to a CRT, the free end of the band is passed completely around the sidewall to form a loop about the sidewall. The free end of the band is overlapped by the looped band and thus lies between the looped band and the sidewall. The free end is firmly grasped by a holding device and a tensioning device pulls the other end of the band to tension the looped band around the article. After the desired tension is reached, the overlapped portion between the two ends is crimped to permanently retain the tension in the looped band. A problem frequently arises in the implosion proofing of a CRT because the free end of the band must be firmly grasped while the tensioning force is being applied. Accordingly, the holding device typically is heavy and quite bulky. Accommodation of the bulky holding device, necessitates the displacement of the band from the CRT sidewall. As a result, when the holding device is removed, the band closes against the sidewall resulting in a substantial relaxation of the band tension.

The instant invention is directed toward a novel band configuration which prevents the tensioned band from moving against the CRT sidewall when the holding device is removed.

The instant invention can be made using the invention described in Application Ser. No. 200,538 filed of even date herewith by Laurence B. Kimbrough and entitled "Holding and Notching Tool for CRT Implosion Protection" now U.S. Pat. No. 4,356,845.

SUMMARY OF THE INVENTION

A tensioning band is looped about an article to be tensioned. A first end of the band is overlapped by the looped band to lie between the looped band and the article. A second end of the band lies outside the loop to form the overlapped portion between the two ends. The overlapped portion is permanently crimped together. The first end includes notches on both edges to form tabs which extend away from the plane of the end to keep the looped band spaced from the article in the vicinity of the first end.

DETAILED DESCRIPTION OF THE PREFERRED EMBODIMENT

Figure 1:
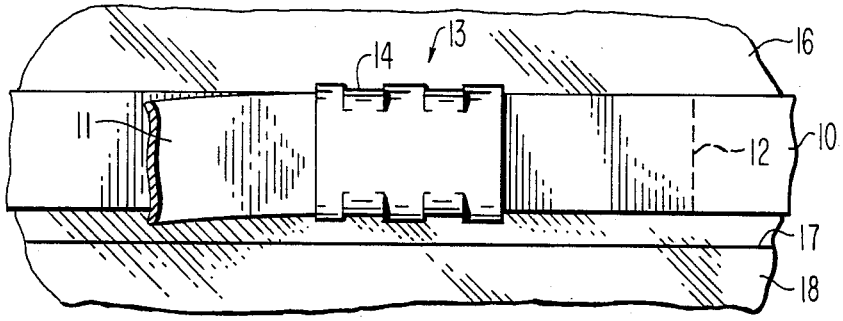
FIG. 1 is a side view, partially broken away, showing an implosion protection band looped around a CRT.
Figure 2:
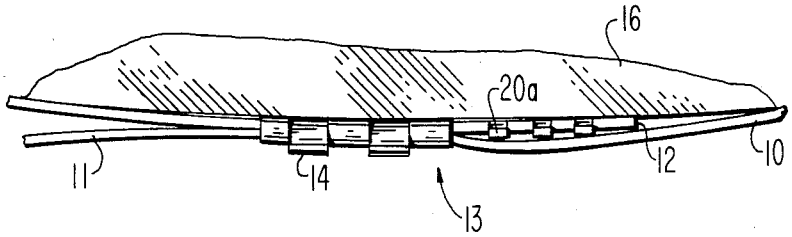
FIG. 2 is a top view, partially broken away, showing an implosion protection band looped around a CRT.

As shown in FIGS. 1 and 2, an implosion protection band 10 is looped around a CRT along the stress area on the faceplate panel sidewall between a faceplate panel 16 and a frit seal 17 where the faceplate panel 16 is joined to a funnel portion 18 of the CRT envelope. The band 10 is connected to a supply of banding material (not shown) by a broken off end 11. A free end 12 of the band is arranged between the looped band and the CRT resulting in an overlapped portion 13 between the two ends 11 and 12. A clip 14 is placed over the overlapped portion 13 and a crimping device of known type crimps the clip and overlapped portion together.

During tensioning the free end 12 is firmly grasped by a holding device and a tensioning device pulls the end 11 of the looped band 10 to tension the band tightly around the CRT. The holding device preferably is of the type described in the previously referenced U.S. Pat. No. 4,356,845. The holding device must resist the pulling force of the tensioning device to avoid relative movement between the free end 12 and the CRT and thus must be quite bulky. Accommodation of the holding device between the looped band and the free end 12, therefore, requires the looped band to be displaced from the CRT. As a result, when the holding device is removed the band closes against the CRT resulting in a substantial relaxation of the tension in the band. The instant invention overcomes this difficulty by prohibiting the looped band from moving into contact with the CRT and thus substantially reduces the tension relaxation.

Figure 3:
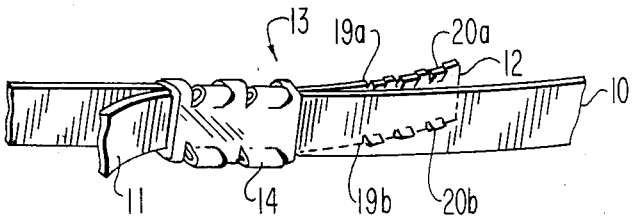
FIG. 3 is a preferred embodiment of the instant invention.

As shown in FIG. 3, the free end 12 of the band 10 has a plurality of notches **19*a* along one edge and a plurality of similar notches 19*b* along the other edge. The notches 19*a* and 19*b* along the two edges preferably are transversely aligned across the width of the end 12. During the formation of the notches 19*a* and 19*b*, the metal is not removed but rather is bent over to form a plurality of tabs 20*a* and 20*b* spaced along the two edges of the free end 12**.

The number of notches, and thus also the number of tabs, is a function of the desired tension to be applied to the band 10. Accordingly, as the desired tension increases the number of notches also can be increased since the sides of the notches resist the pulling force. The depth of the notches also is a function of the desired tension because the sides of the notches resist the pulling force. Accordingly, the notch depth also can be increased as the desired tension increases. However, the portion of the band remaining between the notches must be sufficiently strong to withstand the pulling force of the tensioning device. Accordingly, the notches **20*a* and 20*b* each have a depth which preferably is about 6% to 8% of the transverse width of the band. The tabs 20*a* and 20*b* are formed to extend away from the CRT toward the looped band 10. Accordingly, as more clearly shown in FIG. 2, space is provided to accommodate a holding device between the looped band 10 and the CRT sidewall. However, when the holding device is removed, the looped band 10 cannot move against the CRT because the tabs 20*a* and 20*b*** inhibit such movement.

What is claimed is:

1. In a looped tensioning band having a first end and a second end, and arranged about an article being tensioned with said first end between said looped band and said article to form an overlapped portion between said first and second ends, an improvement comprising:

at least one notch in each edge of said first end to form at least one tab in each edge of said first end in the proximity of said overlapped portion;

said tabs extending away from said article, and toward said looped band to hold said looped band displaced from said article in the proximity of said overlapped portion and clip means attaching said overlapped portion to said second end.

2. The band of claim 1 wherein said tabs in opposite edges are transversely aligned across the width of said band.

3. The band of claim 2 wherein said notches have a depth equal to approximately 6% to 8% of the width of said band. pg,7

4. A looped band for implosion protecting a CRT comprising:

an overlapped portion between a free end and a tensioning end, said free end lying between said looped band and said CRT;

a plurality of tabs arranged in the edges of said free end and extending away from said CRT and toward said looped band to space said looped band from said CRT.

* * * * *